US005657731A

United States Patent [19]

Kim

[11] Patent Number: 5,657,731

[45] Date of Patent: Aug. 19, 1997

[54] DEVICE FOR ADJUSTING FLOW THROUGH AN INTAKE

[75] Inventor: Yoonsuk Kim, Kyungki-do, Rep. of Korea

[73] Assignee: Hyundai Motor Company, Rep. of Korea

[21] Appl. No.: 561,770

[22] Filed: Nov. 22, 1995

[30] Foreign Application Priority Data

Nov. 24, 1994 [KR] Rep. of Korea ..... 94-31066

[51] Int. Cl.[6] ..... F02D 9/10

[52] U.S. Cl. ..... 123/336

[58] Field of Search ..... 123/336, 337, 123/59.5

[56] References Cited

U.S. PATENT DOCUMENTS 4,408,581 10/1983 Pfalzgraf et al. ..... 123/337
4,688,533 8/1987 Otobe ..... 123/336
4,827,884 5/1989 Cook ..... 123/336
4,892,071 1/1990 Asayama ..... 123/336

*Primary Examiner*—Andrew M. Dolinar
*Attorney, Agent, or Firm*—Finnegan, Henderson, Farrabow, Garrett & Dunner, L.L.P.

[57] ABSTRACT

The invention provides a device for adjusting an intake in accordance with the loading condition in overall speed range including: a plurality of small valves for opening or shutting the intake duct, a plurality of large valves for opening or shutting the intake duct in which the small valves are formed, i.e. each of small valve is inscribed with the corresponding large valve, a first driving means for operating the small valves and a second driving means for operating the large valves, all which can turn in a positive and a negative directions, wherein the small valves are integrally mounted on a shaft of the first driving means and large valve means are unitarily mounted on a shaft of the second driving means, the shaft of the second driving means is a hollow shaft and the shaft of the first driving means is fitted to the hollow shaft through a hollow portion thereof, each shaft rotates independently, and an electronic control unit (ECU) for controlling the driving means according to a load condition in an over-all speed range.

4 Claims, 7 Drawing Sheets

DEVICE FOR ADJUSTING FLOW THROUGH AN INTAKE

BACKGROUND OF THE INVENTION

1. Field of the Invention

The invention relates to an intake adjusting device for an internal combustion engine and, more particularly, to the device which can adjust an amount of intake to the combustion chamber according to a load condition in an over-all speed range so as to enhance combustibility, responsiveness, and torque of the engine.

2. Description of the Prior Art

Generally, in a low load running condition such as warming up or idling, the amount of intake air or intake fuel to the engine is of small quantity and a current speed of the air is reduced. It deteriorates the combustibility of the engine and debases the responsiveness and the acceleration-ability of the engine.

To solve the above problem, it is proposed to provide a device that has an intake duct for a low load running and another intake duct for a high load running to selectively use one of them in accordance with the load condition.

But, the said device can not adjust the amount of intake in an over-all speed range because the intake ducts are just opened or shut according to the load condition.

SUMMARY THE INVENTION

The present invention has been made in an effort to solve the problem.

It is the object of the invention to provide a device which can adjust an amount of intake to the combustion chamber according to the load condition in an over-all speed range so as to enhance combustibility, responsiveness, and torque of the engine.

To achieve the object, the invention provides a device for adjusting an intake which is installed in an intake duct to a combustion chamber including: a plurality of small valves for opening or shutting the intake duct, a plurality of large valves for opening or shutting the intake duct in which the small valves are formed, i.e. each of small valve is inscribed with the corresponding large valve, a second driving means for operating the small valves and a first driving means for operating the large valves, all which can turn selectively in a positive and a negative directions, wherein the small valves are integrally mounted on a shaft of the second driving means and large valve means are unitarily mounted on a shaft of the first driving means, the shaft of the first driving means is a hollow shaft and the shaft of the second driving means is fitted to the hollow shaft through a hollow portion thereof, as a result, each shaft rotates independently, and an electronic control unit (ECU) for controlling the driving means according to a load condition in an overall speed range.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF A PREFERRED EMBODIMENT

A preferred embodiment of the present invention will now be described in detail with reference to the accompanying drawings.

Figure 1:
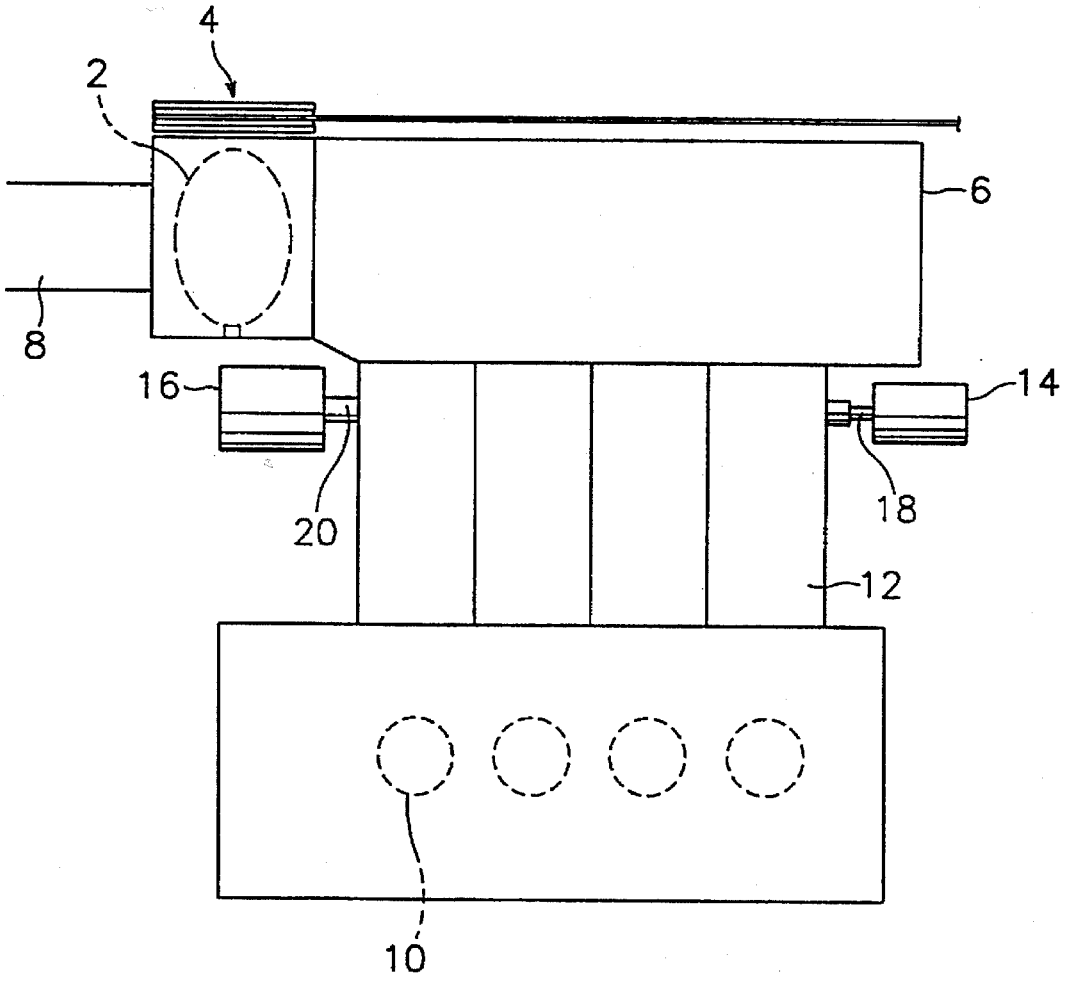
FIG. 1 shows a plan view of a induction system to which a preferred embodiment of the invention can be applied.

Referring to FIG. 1, it shows a plan view of a induction system to which a preferred embodiment of the invention can be applied. There shows a throttle valve pulley assembly 4 for opening or shutting a throttle valve 2 connected with a accelerating pedal (not shown), an air intake hoses for inducing the air from an air cleaner (not shown) to a surge tank 6 according to the opening of the throttle valve 2, and a plurality of intake ducts 12 for leading the air induced to the surge tank 6 to combustion chambers 10. It is possible to connect the intake ducts to the combustion chambers by two intake ducts, in which one is for low load and the other is for high load, to one combustion chamber connection method as employed in a high performance engine as well as by one intake duct to one combustion chamber connection method.

A device which is provided by an embodiment according to the invention that can vary the areas of the intake ducts 12 in accordance with the speed range of the engine.

The device can be equipped between the surge tank 6 and the intake duct 12 or with a cylinder head passage if the intake ducts 12 are connected to the combustion chambers, respectively, and with the intake duct for high load if the intake ducts 12 are connected to the combustion chambers by two intake ducts to one combustion chamber connection method.

The device includes two stepping motors which turn in a positive or negative directions by the control of ECU and the one of the driving shafts of the motors is hollow and the other shaft is fitted to the hollow shaft through a hollow portion thereof. Each shaft turns independently.

Figure 2:
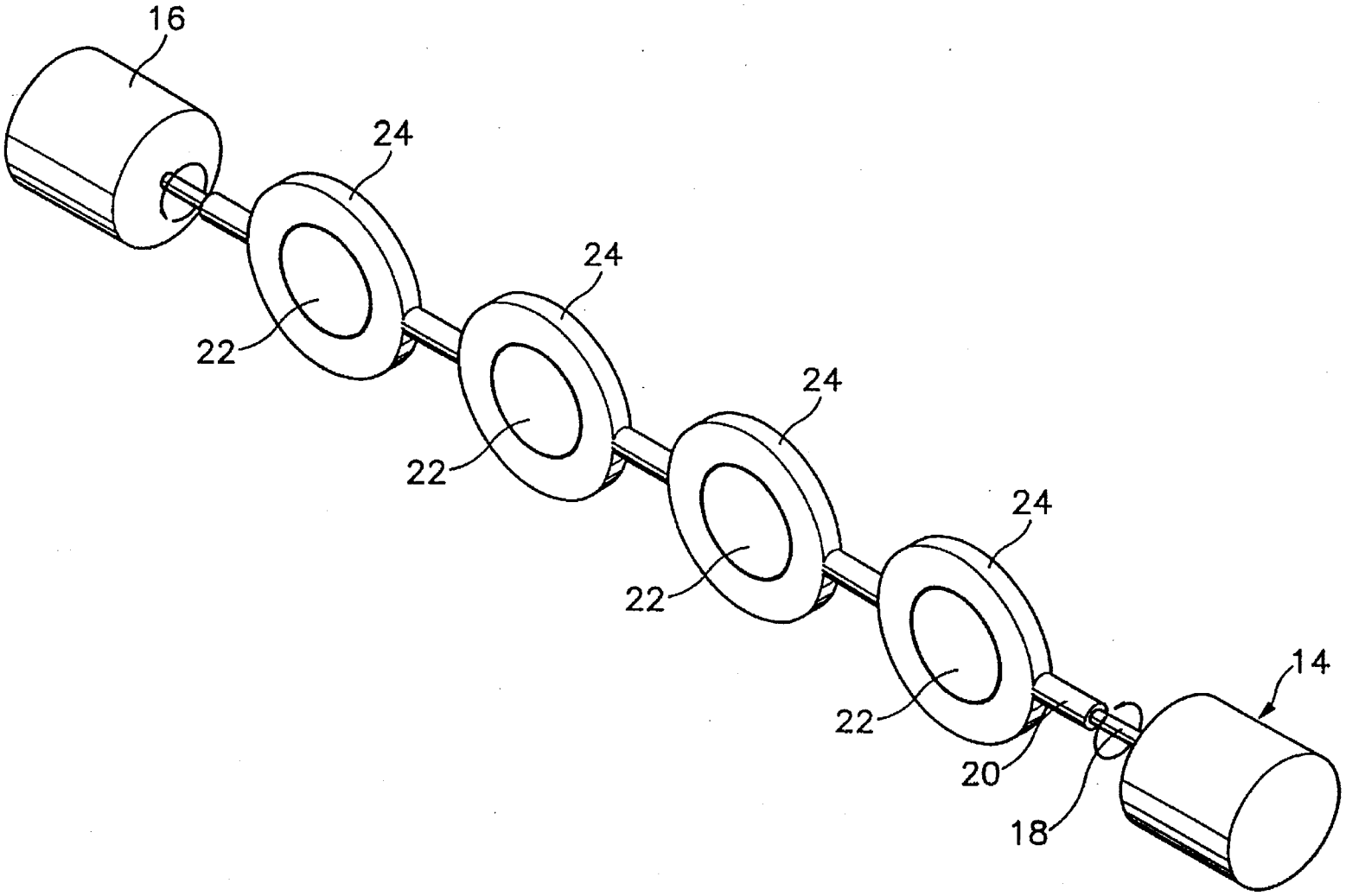
FIG. 2 is a perspective view of a device according to the embodiment of the invention.
Figure 3A:
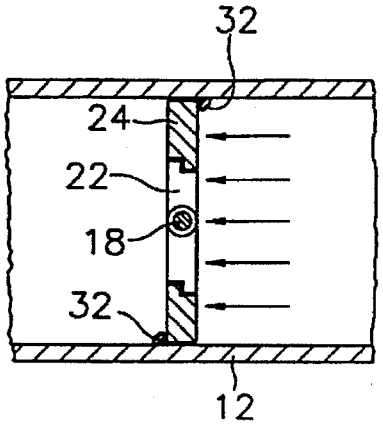
FIGS. 3A to 3E are views illustrating how the embodiment is operated.
Figure 3B:
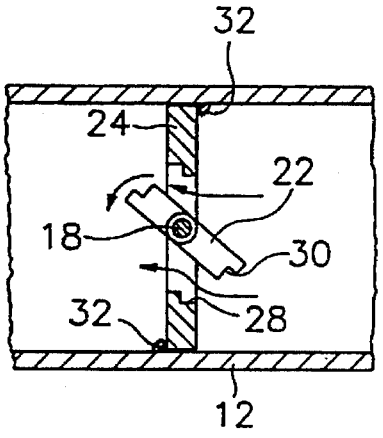
Figure 3C:
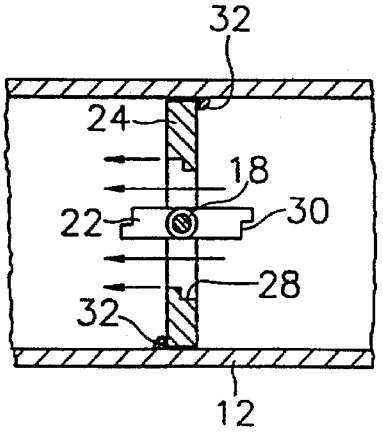
Figure 3D:
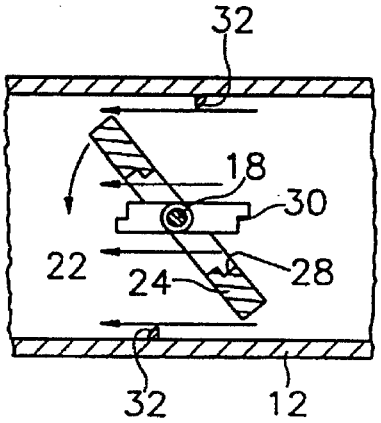
Figure 3E:
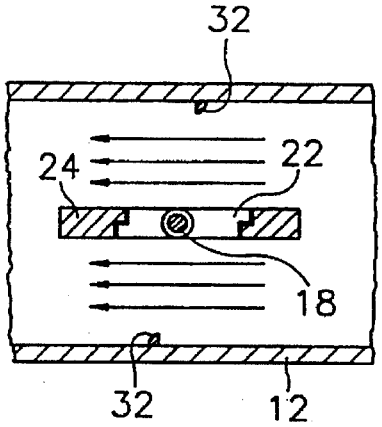

FIG. 2 shows a perspective view of the device and the shaft 18 of the motor 14 is fitted to the hollow shaft 20 of the motor 16. Each shaft rotates independently as described.

Valve means are mounted on the shafts 18 and 20. Small valves 22 are integrally mounted on the shaft 18 and large valves 24 are unitarily mounted on the shaft 20. Each of small valve is inscribed with the corresponding large valve.

The number of the valve means depend on the number of the cylinder, for example, there will be 4 valve means in 4 cylinder engine.

When the motors are driven selectively, the small valves or large valves are turned and, as a result, they open or shut the intake ducts.

There are protrusions 28 for the large valves 24 and 30 for the small valves 22 and they are served to keep the small valves 22 in parallel with the large valves 24 when the small valves are shut regardless of over turning of the small valves 22.

The shape of the large valves 24 should correspond with the inner shape of the intake duct 12 to be fitted in the intake duct 12 and this embodiment employs the shape of circle, but the shape is not limited in the circular shape.

A numeral 32 is a stopper for preventing the large valves 24 from over turning installed in the inside of the intake ducts 12.

FIG. 3 is a view illustrating how the embodiment is operated and the engine employed in this case has multiple intake ducts for one combustion chamber.

Figure 4A:
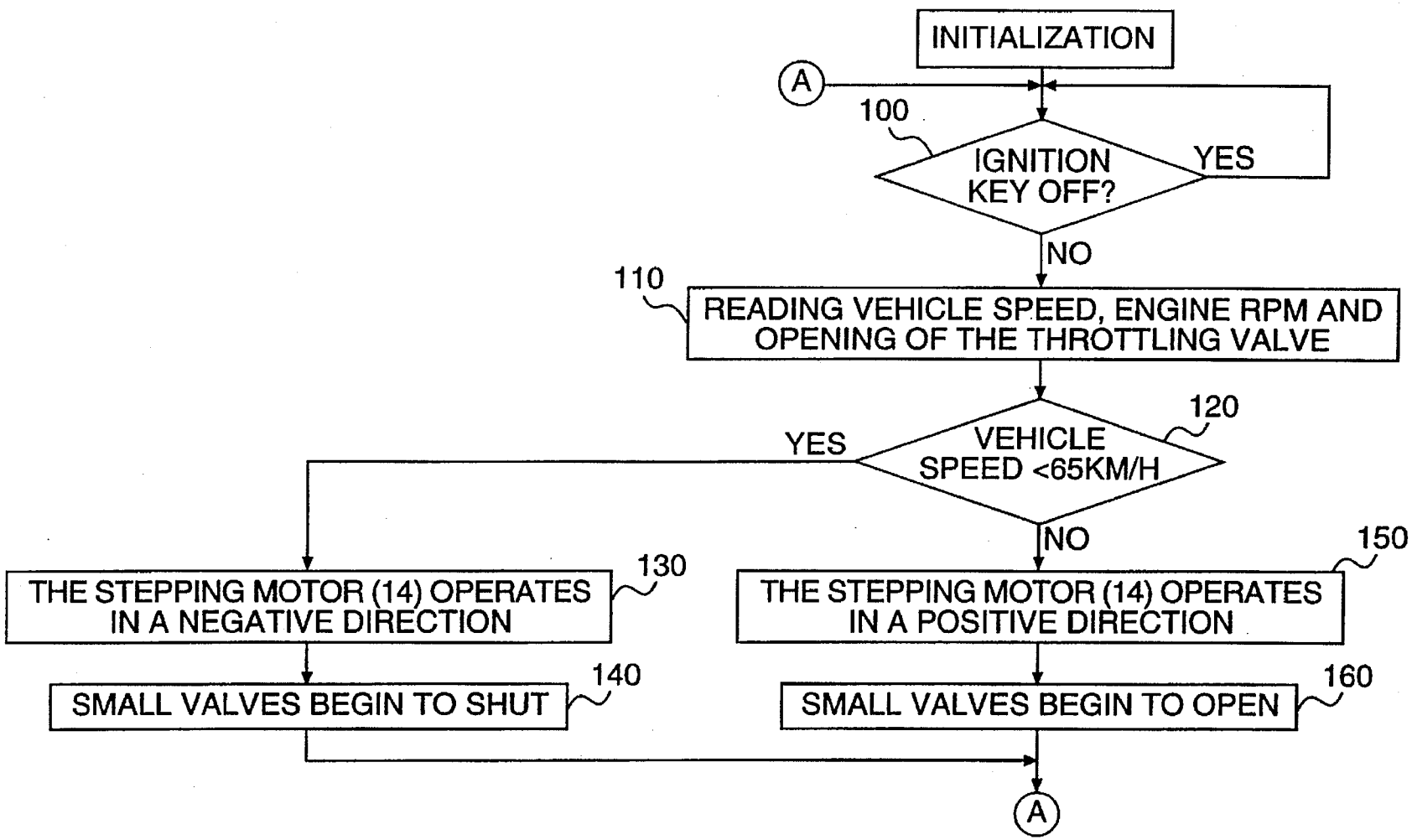
FIGS. 4A and 4B are views showing the flow chart for controlling the operation of the embodiment.
Figure 4B:
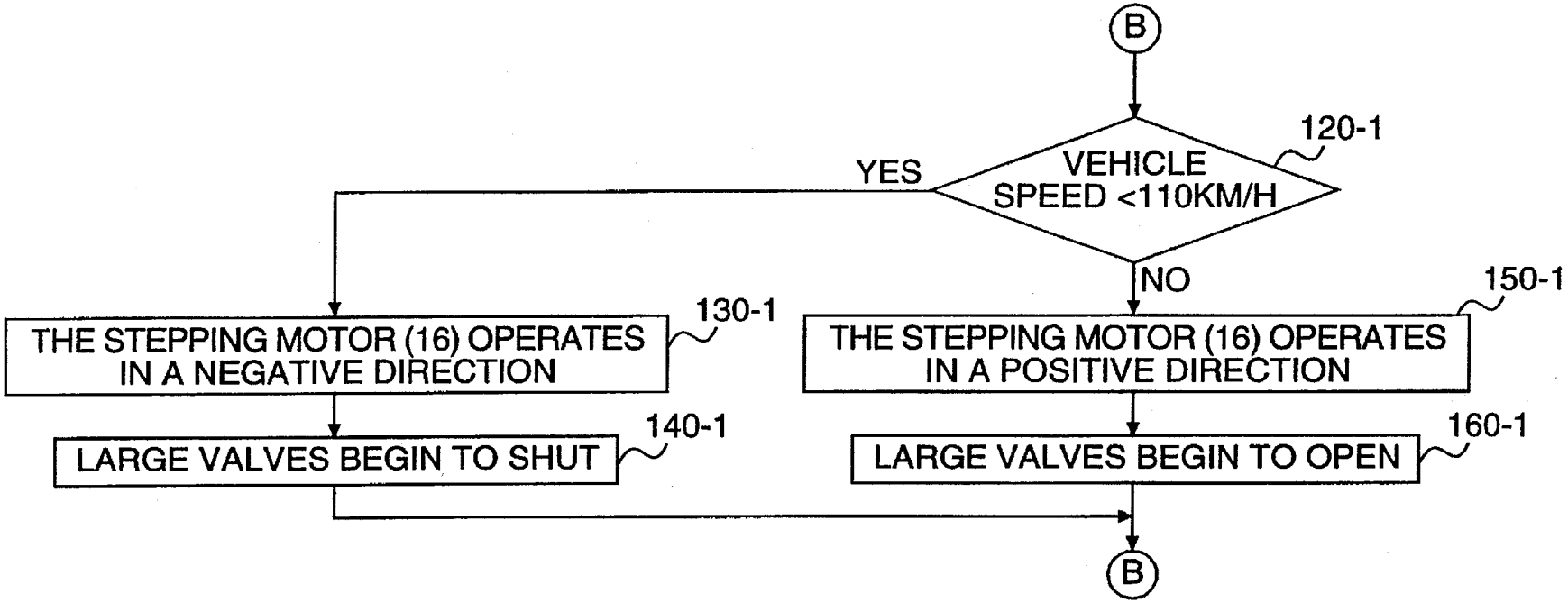

FIG. 4 is a view showing the flow chart for controlling the operation of the embodiment.

FIG. 3 (A) shows a low load condition and the valve means shut the intake valve wholly. The opening of the valve means grows gradually following (B), (C), (D), and (E) according to the vehicle's speed.

By combining FIG. 3 with FIG. 4, it will be understood how the openings of the valve means are changed in accordance with the vehicle's speed.

Firstly, FIG. 4 (A) is described.

In a step 1 100, the ECU determines whether an ignition key is off or not and if the ignition key is not off, the step goes to a step 2 110.

In the step 2 110, the ECU receives the signals of representing the vehicles's speed, the engine rpm, and the position of the throttling valve from a vehicle speed sensor, a engine rpm sensor and the throttle valve position sensor (TPS), respectively.

And then, in a step 3 120, the ECU determines whether the vehicle's speed is over 65 km/h or not. If the vehicle's speed is over 65 km/h, the step goes to a step 6 150 and if the vehicle's speed is not over 65 km/h, the step goes to a step 4 130.

In the step 4 130, the ECU operates the stepping motor 14 to negative direction(or clockwise direction viewed in FIG. 3) and the small valves 22 begins to shut the intake valves in a step 5 140.

In the step 6 150 in condition of which the vehicle's speed is over 65 km/h, the ECU operates the stepping motor 14 to positive direction(in FIG. 3, the counterclockwise) and the small valves begin to open the intake valves in a step 7 160.

These steps of 150 and 160 correspond to FIG. 3 (B) and if the vehicle speed is increased more and more, the stepping motor 14 operates the small valves to further open the intake ducts corresponding to FIG. 3 (C). During the time the small valves being opened, the large valves are kept in a shut position.

After the small valves are opened wholly, the ECU determines whether the vehicle's speed is over 110 km/h or not in a step 3-1 120-1 as shown in FIG. 4 (B). If the vehicle's speed is not over 110 km/h, step goes to a step 4-1 130-1 in which the ECU operates the stepping motor 16 to negative direction and, in a step 5-1 140-1, the large valves begin to be shut if the large valves 24 is in condition of being opened.

However, if the vehicle's speed is over 110 km/h in the step 3-1 120-1, the stepping motor 16 is operated to positive direction in a step 6-1 150-1 and the large valves are going to be opened in a step 7-1 160-1 corresponding to FIG. 3 (D).

In this situation, if the vehicle speed is increased more and more, the stepping motor 16 operates the large valves 24 to further open the intake ducts corresponding to FIG. 3 (E) in which the valve means are opened wholly.

Therefore the embodiment according to the invention operates the valve means to vary the area of the intake ducts according to travelling condition.

In a low speed range, the valve means set the area of intake ducts small and the flow of intake is increased. As a result the combustibility is enhanced.

In a high speed range, the amount of intake reach a maximum and torque of engine is enhanced in over-all speed range.

Figure 5:
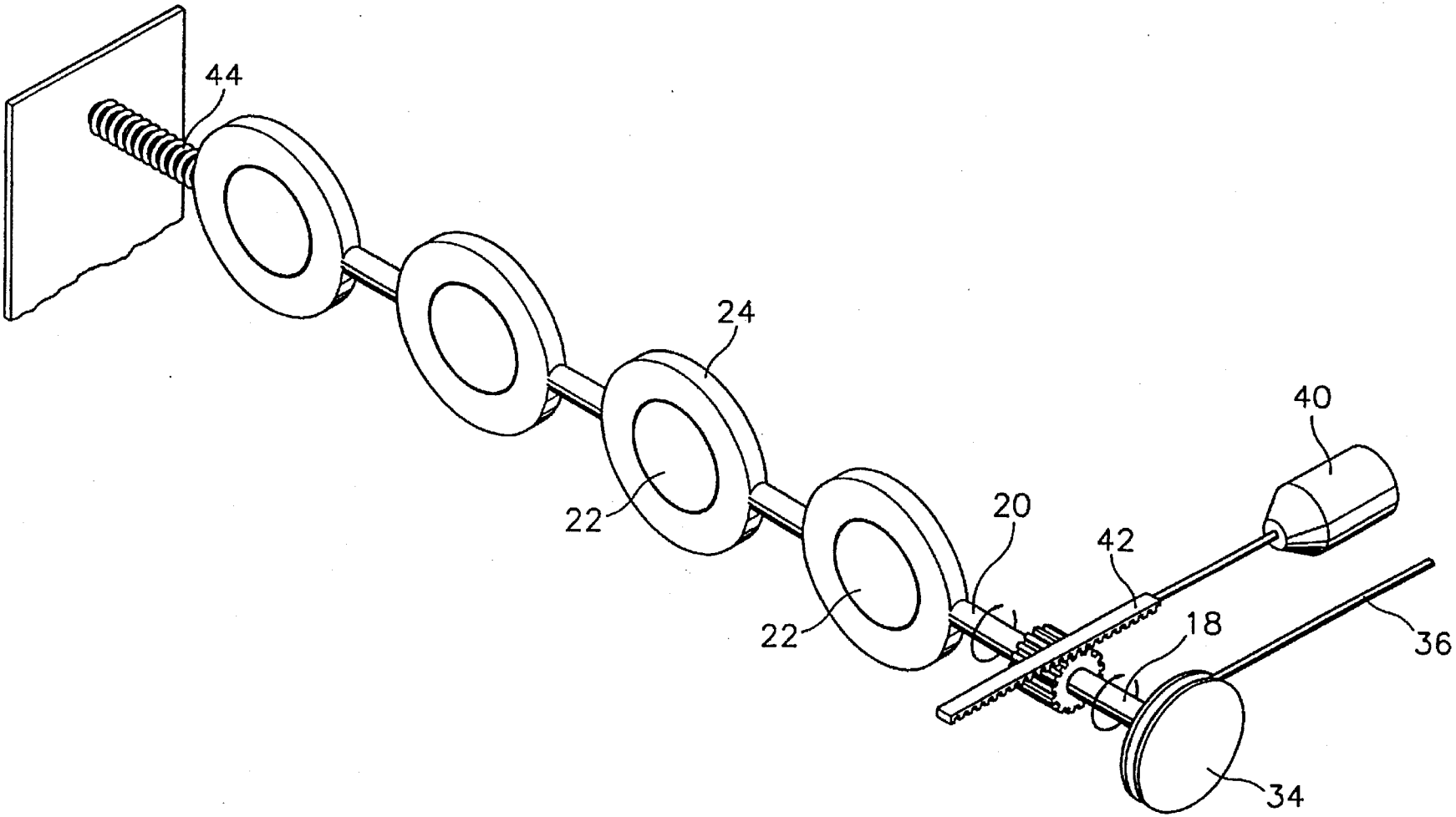
FIG. 5 is a perspective view of a device according to another preferred embodiment of the invention.
Figure 6A:
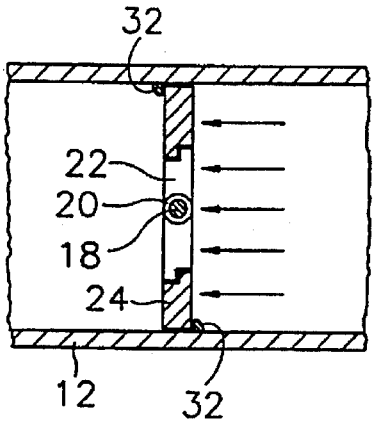
FIGS. 6A to 6E are views illustrating how the other embodiment is operated.
Figure 6B:
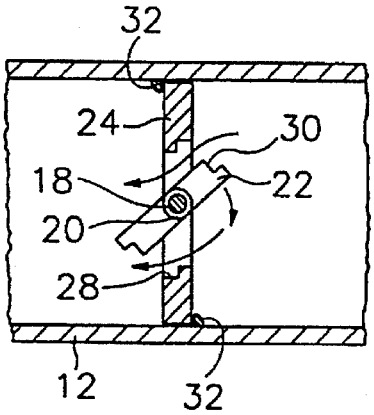
Figure 6C:
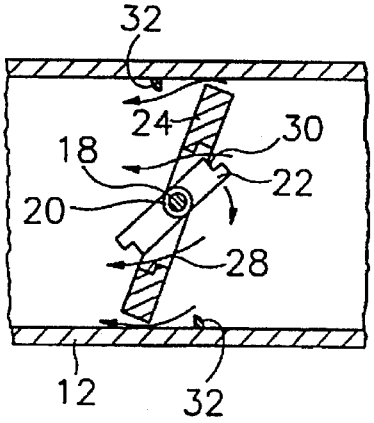
Figure 6D:
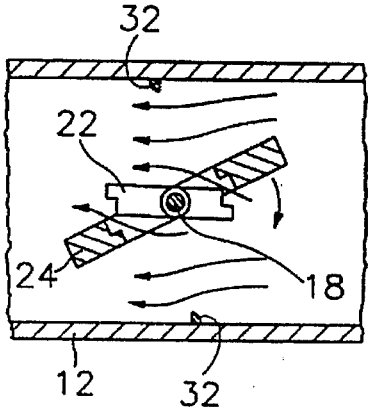
Figure 6E:
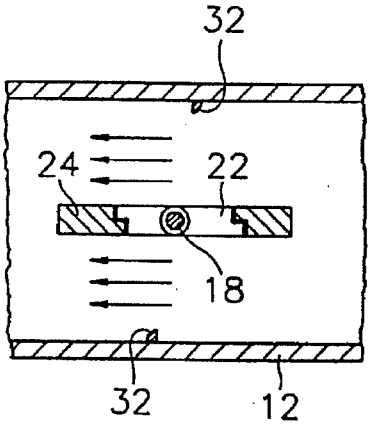

Now, another embodiment according to the invention is illustrated with reference to FIGS. 5 and 6.

Valve means including a small valves 22 and a large valves 24 is same as the first embodiment. The small valves 22 are integrally mounted on a driving shaft 18 and the large valves 24 are unitarily mounted on a shaft 20 which is hollow and to which the shaft 18 is fitted. Each of small valve is inscribed with the corresponding large valve.

But a driving means for operating the valve means are different from the first embodiment. A pulley 34 is mounted on the end of the shaft 18 and is connected with the accelerating pedal through a wire 36. A pinion 38 is mounted on the shaft 20 and is engaged with a rack 42 which is connected to an actuator 40. The actuator 40 is operated to forward or rearward by a negative pressure of the induction system. The shaft 20 is provided with a elastic member 44 such as a torsion coil spring to prevent a turning of it at initial time.

When a driver pushes the accelerating pedal, wire 36 connected with the throttle valve pulley is pulled and the shaft 18 is turned to operate the small valve 22 to a direction of opening the intake duct. This state corresponds to FIG. 6 (A) and (B).

Then if the accelerating pedal is pushed further, the opening of the small valves 22 is increased as shown in FIG. 6 (C). During the time, the large valves 24 are kept in a shut state because the elastic force is larger than the negative pressure of the induction system. But as the negative pressure is increased by the further pushing of the accelerating pedal, the larger valves 24 begin to be opened.

At this condition, if the vehicle's speed is increased more and more, the large valves are opened gradually according to the increased speed as shown in FIG. 6 (D) and finally the valve means is opened wholly as shown in FIG. 6 (E).

What is claimed is:

1. A device for adjusting flow through an intake duct connected to a combustion chamber, comprising:

a first hollow shaft traversing the intake duct;

a second shaft passing through the first hollow shaft, so that the first hollow shaft and the second shaft rotate independently of one another;

a plurality of small valves for opening or shutting the intake duct, each of the plurality of small valves being on the second shaft;

a plurality of large valves for opening or shutting the intake duct, each of the plurality of large valves being on the first shaft and having an inner surface inscribing a respective one of the small valves;

first driving means for rotating the first shaft in opposite directions;

second driving means for rotating the second shaft in opposite directions; and an electronic control unit for controlling the first and second driving means according to a load condition in an over-all speed range.

2. The device as set forth in claim 1, wherein the driving means are stepping motors.

3. A device for adjusting the flow through an intake duct connected to a combustion chamber, comprising:

a first hollow shaft traversing the intake duct;

a second shaft passing through the first hollow shaft, so that the first hollow shaft and the second shaft rotate independently of one another;

a plurality of small valves for opening or shutting the intake duct, each of the plurality of small valves being on the second shaft;

a plurality of large valves for opening or shutting the intake duct, each of the plurality of large valves being on the first shaft and having an inner surface inscribing a respective one of the small valves;

first driving means for rotating the first shaft in opposite directions, the first driving means comprising a pinion mounted on the first shaft, a rack engaging the pinion, and an actuator for moving the rack in response to negative pressure of an induction system; and second driving means for rotating the second shaft in opposite directions the second driving means comprising a pulley mounted on an end of the second shaft, the pulley being connected to an accelerator pedal through a wire so that movement of the accelerator pedal rotates the second shaft and the small valves to open or shut the intake duct.

4. The device of claim 3, further comprising a torsion spring connected to the first shaft.

* * * * *